US008047045B2

(12) United States Patent
Gharib

(10) Patent No.: US 8,047,045 B2
(45) Date of Patent: Nov. 1, 2011

(54) APPARATUS AND METHOD FOR FORMING A TUBE WITH A TETRAGONAL CROSS-SECTION, HAVING A REINFORCED END

(76) Inventor: Mohamed Gharib, Cambridge (CA)

( * ) Notice: Subject to any disclaimer, the term of this patent is extended or adjusted under 35 U.S.C. 154(b) by 925 days.

(21) Appl. No.: 12/034,261

(22) Filed: Feb. 20, 2008

(65) Prior Publication Data

US 2008/0196230 A1 Aug. 21, 2008

Related U.S. Application Data

(60) Provisional application No. 60/902,100, filed on Feb. 20, 2007.

(51) Int. Cl.

| | |
|---|---|
| ***B21D 22/00*** | (2006.01) |
| ***B21D 41/00*** | (2006.01) |
| ***B21C 37/15*** | (2006.01) |

(52) U.S. Cl. ..... 72/370.23; 72/359; 72/354.6; 72/370.1

(58) Field of Classification Search ..... 72/352, 72/354.6, 358, 359, 370.1, 370.11, 370.14, 72/370.23, 370.26, 405.03, 405.01, 472, 72/470, 353.2, 355.2, 355.6, 367.1, 368

See application file for complete search history.

(56) References Cited

U.S. PATENT DOCUMENTS

| | | | | |
|---|---|---|---|---|
| 1,966,053 | A * | 7/1934 | Squires | 72/342.1 |
| 6,408,672 | B1 | 6/2002 | Roe et al. | |
| 6,931,906 | B2 * | 8/2005 | Sorgi | 72/370.03 |

* cited by examiner

*Primary Examiner* — Debra Sullivan

(57) ABSTRACT

An apparatus for cold-forming a workpiece having a substantially round cross-section and an elongate body into a tube having a main portion with a substantially tetragonal cross-section and a reinforced end. The apparatus includes a die in which a received portion of the body of the workpiece is receivable and from which a preselected portion of the body extends, and a first punch adapted to bend the preselected portion radially outwardly to form a curled end. The apparatus also includes a second punch to form the curled end into a round reinforced end, and a die subassembly for forming the received portion of the body of the workpiece into the main portion of the tube having the substantially tetragonal cross-section and for forming the round reinforced end into the reinforced end of the tube.

8 Claims, 16 Drawing Sheets

F6
419
417
425
425
423
417
421
427

411
415
44
22
409
413
492
491
415
36
407
492
H
415

F6
419
403
405
r
415
444
36

415
422
403
405
r
444
J
417
403
r
405
444

APPARATUS AND METHOD FOR FORMING A TUBE WITH A TETRAGONAL CROSS-SECTION, HAVING A REINFORCED END

This application claims the benefit of U.S. Provisional Patent Application No. 60/902,100, filed on Feb. 20, 2007.

FIELD OF THE INVENTION

This invention is related to an apparatus and a method for forming a tube with a tetragonal cross-section, having a reinforced end.

BACKGROUND OF THE INVENTION

Tubes with substantially tetragonal (e.g., rectangular or square) cross-sections and reinforced ends are used in many applications, e.g., trailer hitch-receiving tubes mounted at a back end of a vehicle. As is well known in the art, a trailer hitch assembly typically includes a frame portion which is attached to the vehicle's chassis, and the hitch-receiving tube is attached to the frame portion.

In the prior art, the reinforced end may be formed by welding a ring to a tube with a tetragonal cross-section. The ring is rectangular or square, as required to fit onto the tube, and is sized accordingly. However, a reinforced end formed in this way (i.e., one including a ring welded to the tube) is particularly susceptible to corrosion, due to salt and water off the roadway. Also, the welded ring tends to be less aesthetically appealing. A tube 10 with a tetragonal cross-section and a reinforced end 11 formed in this way are shown in FIGS. 1A and 1B.

A particular method of cold-forming the reinforced end is known, and is disclosed in U.S. Pat. No. 6,408,672 (Roe et al.). In this method, an end of a tube which is tetragonal in cross-section is cold-formed into a reinforced end. However, because the tube is tetragonal in cross-section, extreme pressure is required to cause material at the end of the tube to buckle and form as required in accordance with the invention disclosed in Roe et al. A tube 12 with a tetragonal cross-section and a reinforced end 13 formed in this way are shown in FIGS. 2A and 2B. (As will be described, the remainder of the drawings illustrate the present invention.) This prior art method has some obvious disadvantages, e.g., a very large press is required in order to exert the very high pressures needed, and the extreme pressure also causes excessive wear and breakage at the tooling surfaces in contact with the deformed area.

SUMMARY OF THE INVENTION

In its broad aspect, the invention provides an apparatus for cold-forming a workpiece having a substantially round cross-section and an elongate body into a tube having a main portion with a substantially tetragonal cross-section and a reinforced end. The apparatus includes a die in which a received portion of the body of the workpiece is receivable and from which a preselected portion of the body extends, a first punch for bending the preselected portion substantially radially outwardly to form a curled end on the workpiece, and a press means for exerting a first force on the first punch to form the preselected portion into the curled end on the workpiece. In addition, the apparatus includes a second punch for pressing a preselected part of the curled end radially inwardly toward an inner part of the curled end, to form the curled end into a round reinforced end on the workpiece. Also, the apparatus includes press means for exerting a second force on the second punch to form the curled end into the round reinforced end on the workpiece. The apparatus also includes a die subassembly for forming the received portion of the body of the workpiece into the main portion of the tube having the substantially tetragonal cross-section and for forming the found reinforced end into the reinforced end of the tube. Also, the apparatus includes press means for exerting third and fourth forces on the die subassembly to form the received portion into the main portion of the tube and to form the round reinforced end into the reinforced end of the tube.

In another aspect, the invention provides a second die in which the main portion of the tube is receivable, a third punch for forming a curved part of the reinforced end into a flattened part of a modified reinforced end to provide a modified tube, and press means for exerting a fifth force on the curved part to form the flattened part.

In another aspect, the invention provides a tube having a main portion with a substantially tetragonal cross-section and a reinforced end. The tube is produced by a method including, first, positioning a received portion of the body of the workpiece in a die so that a preselected portion of the body extends from the die. Next, a first punch is positioned on the preselected portion, the first punch being adapted to cooperate with the die to bend the preselected portion substantially radially outwardly to form a curled end on the workpiece. In the next step, a first force is exerted on the first punch to form the preselected portion into the curled end on the workpiece. Next, the first punch is removed. Subsequently, a second punch is positioned on the curled end of the workpiece. Next, a second force is exerted on the second punch to press at least a preselected part of the curled end radially inwardly toward an inner part of the curled end, to form the curled end into a round reinforced end on the workpiece. In the next step, the received portion and the round reinforced end are positioned in a die subassembly for forming the received portion into the main portion of the tube having the substantially tetragonal cross-section and for forming the round reinforced end into the reinforced end of the tube. Finally, forces are exerted on the die subassembly to form the body into the main portion of the tube and to form the round reinforced end into the reinforced end of the tube.

In yet another aspect, the method of the invention additionally includes, first, positioning the main portion of the tube in a second die, and second, positioning a third punch on the reinforced end, the third punch being adapted to form a curved part of the reinforced end into a flattened part of a modified reinforced end to provide a modified tube. Finally, force is exerted on the third punch to form the curved part into the flattened part, to provide the modified tube.

In yet another of its aspects, the invention provides an apparatus for cold-forming a workpiece having a substantially round cross-section and an elongate body into a modified tube having a main portion with a substantially tetragonal cross-section and a modified reinforced end. The apparatus includes a die in which a received portion of the body of the workpiece is receivable, and from which a preselected portion of the body extends, a first punch adapted to cooperate with the die to bend the preselected portion radially outwardly to form a curled end on the workpiece, and press means for exerting a first force on the first punch to form the preselected portion into the curled end on the workpiece. The apparatus also includes a second punch adapted to cooperate with the die to press a preselected part of the curled end radially inwardly toward an inner part of the curled end, to form a round reinforced end, and press means for exerting a second force on the second punch to form the curled end into the round reinforced end on the workpiece. In addition, the apparatus includes a second die in which the received portion of the workpiece is receivable and at least a curved end part of the round reinforced end extends beyond the second die, a third punch for forming the curved end part of the round reinforced end into a flattened end part of a modified round reinforced end of a modified workpiece, and press means adapted to exert a sixth force on the curved end part to form the flattened end part.

In another aspect, the apparatus additionally includes a die subassembly adapted for forming the received portion of the body of the modified workpiece into the main portion of the modified tube having the substantially tetragonal cross-section and for forming the modified round reinforced end into the modified reinforced end of the modified tube, and additional press means adapted to exert third and fourth forces on the die subassembly respectively for forming the received portion into the main portion of the modified tube and for forming the modified round reinforced end into the modified reinforced end of the modified tube.

In another aspect, the invention provides a modified tube having a main portion with a substantially tetragonal cross-section and a modified reinforced end. The modified tube is produced by a method including, first, positioning a received portion of the body of the workpiece in a die, so that a preselected portion of the body extends from the die, and next, positioning a first punch on the preselected portion, the first punch being adapted to cooperate with the die to bend the preselected portion radially outwardly to form a curled end on the workpiece. Next, a first force is exerted on the first punch to form the preselected portion into the curled end on the workpiece. In the next step, the first punch is removed, and subsequently, a second punch is positioned on the curled end of the workpiece. Next, a second force is exerted on the second punch to press a preselected part of the curled end radially inwardly toward an inner part of the curled end to form a round reinforced end. Next, the received portion of the workpiece is positioned in a second die in which the received portion of the workpiece is receivable, so that at least a curved end part of the round reinforced end extends beyond the second die when the received portion is received therein. Subsequently, a third punch is positioned on the round reinforced end, the third punch being adapted to form a curved end part of the round reinforced end into a flattened end part of the modified round reinforce end, to provide a modified workpiece. Next, a fifth force is exerted on the third punch to form the curved end part into the flattened end part.

In the next step, the received portion and the modified round reinforced end of the modified workpiece are positioned in a die subassembly adapted for forming the received portion into the main portion of the modified tube having the substantially tetragonal cross-section and for forming the modified round reinforced end into the modified reinforced end of the modified tube. Next, third and fourth forces are exerted on the die subassembly to form the received portion into the main portion of the modified tube and to form the modified round reinforced end into the modified reinforced end of the modified tube.

BRIEF DESCRIPTION OF THE DRAWINGS

The invention will be better understood with reference to the attached drawings, in which.

DETAILED DESCRIPTION

Figure 5B:
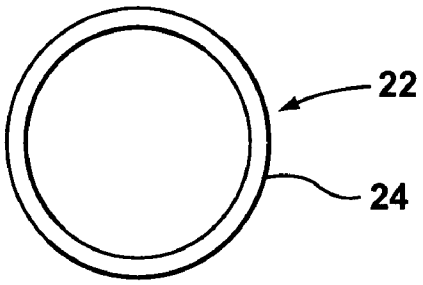
FIG. 5B is an end view of the workpiece of FIG. 5A.
Figure 5A:
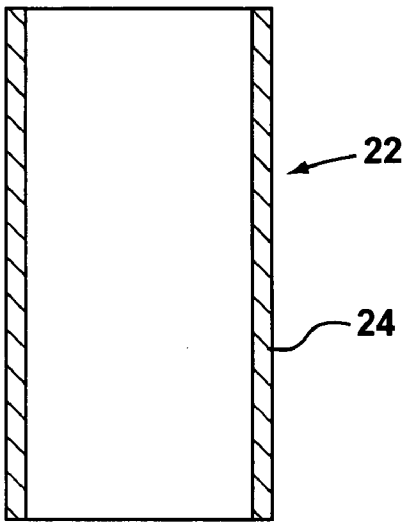
FIG. 5A is a cross-section of a workpiece having a substantially round cross-section.
Figure 5D:
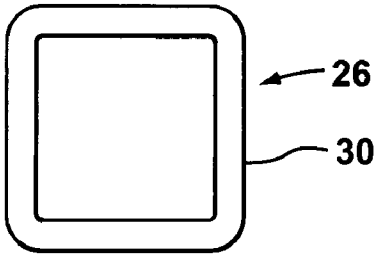
FIG. 5D is an end view of a reinforced end of the tube of FIG. 5C.
Figure 5C:
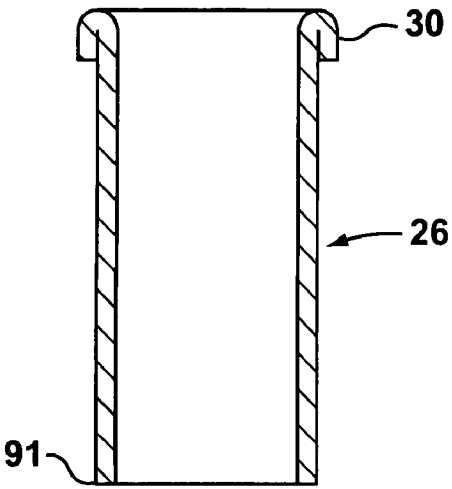
FIG. 5C is a cross-section of an embodiment of the tube of the invention.
Figure 6:
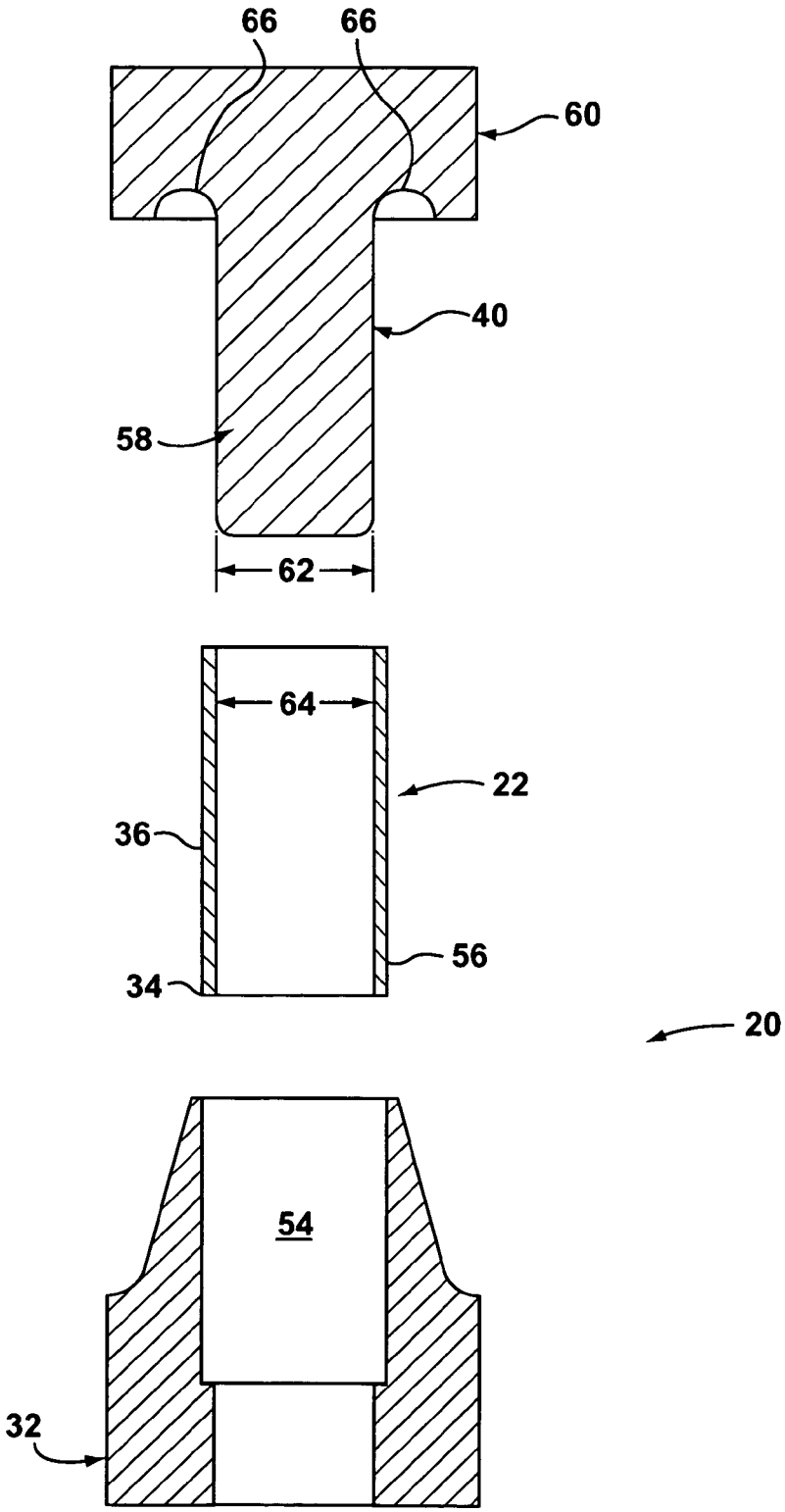
FIG. 6 is an exploded cross-section of an embodiment of a die of the invention, the workpiece positioned to be received in the die, and an embodiment of a first punch of the invention, drawn at a smaller scale.
Figure 8:
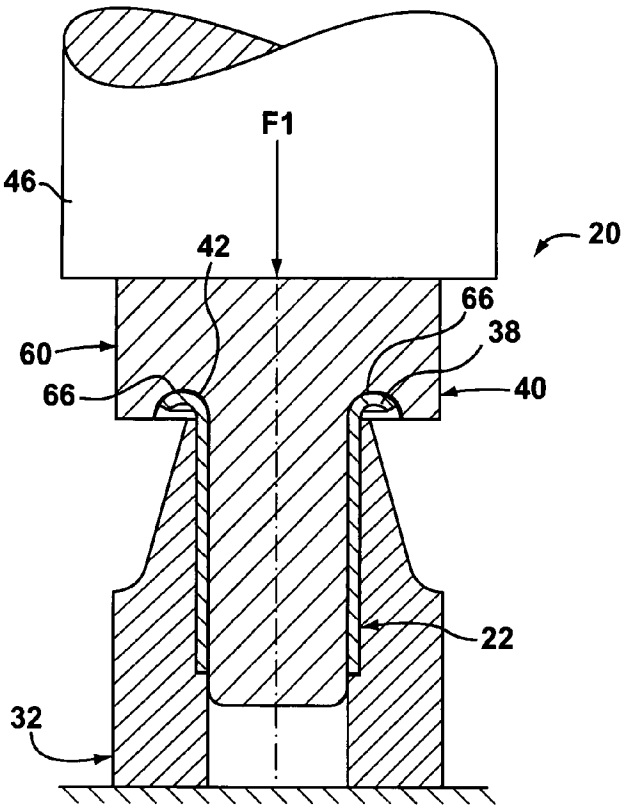
FIG. 8 is a cross-section showing the workpiece, the die, and the first punch in which a curled end is formed on the workpiece.
Figure 7:
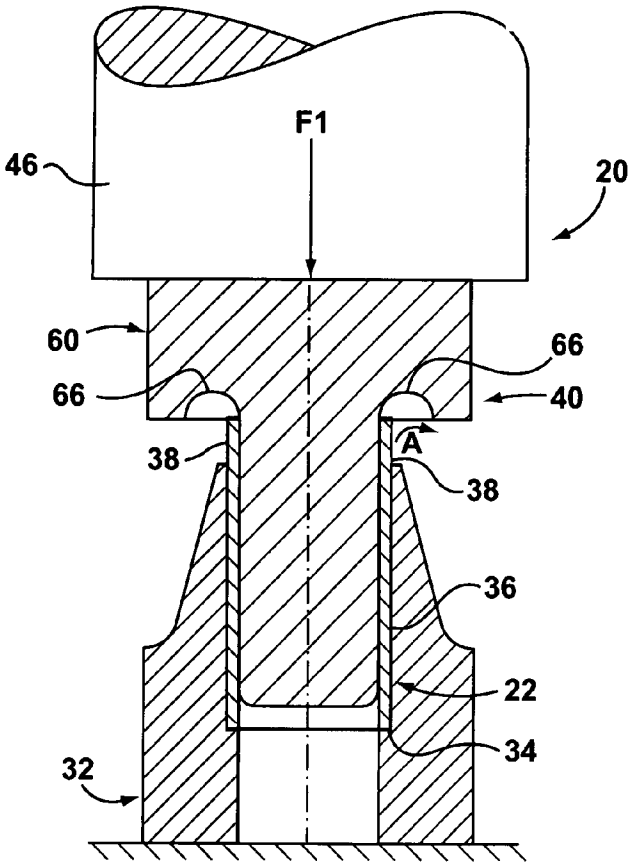
FIG. 7 is a cross-section showing the workpiece partially positioned in the die, with a preselected portion of the workpiece extending above the die and the first punch of FIG. 6 positioned thereon, drawn at a larger scale.
Figure 10B:
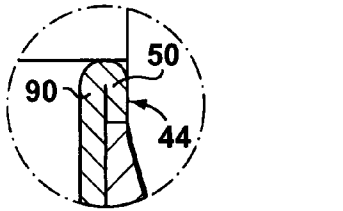
FIG. 10B is a portion of FIG. 10A, drawn at a larger scale.
Figure 9A:
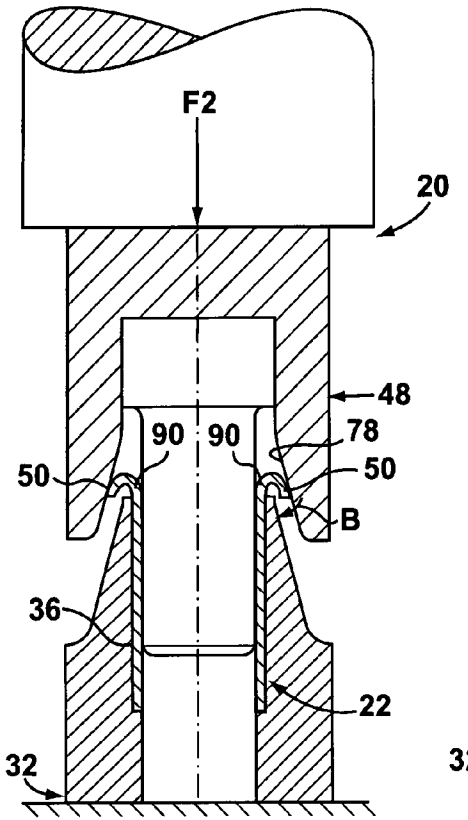
FIG. 9A is a cross-section of the workpiece, the die, and the second punch of FIG. 9 in which a tapered surface on the second punch engages a preselected part of the curled end.
Figure 9:
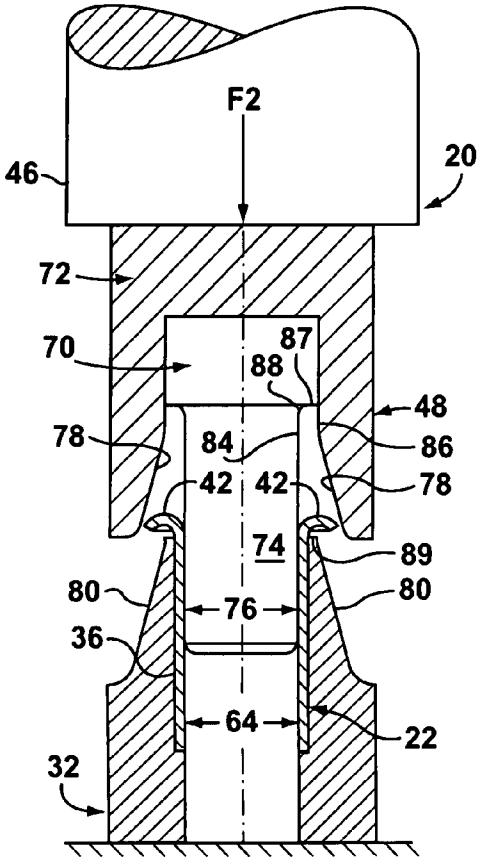
FIG. 9 is a cross-section in which the workpiece is positioned in the die with an embodiment of a second punch of the invention positioned to engage the curled end of the workpiece, drawn at a smaller scale.

Reference is first made to FIGS. 3A-3C and 5A-13B to describe an embodiment of an apparatus of the invention indicated by the numeral 20. The apparatus 20 is for cold-forming a workpiece 22 having a substantially round cross-section and an elongate body 24 (FIGS. 5A, 5B) into a tube 26 having a main portion 28 with a substantially tetragonal cross-section and a reinforced end 30 (FIGS. 5C, 5D). In one embodiment, the apparatus 20 preferably includes a die 32 in which a first end 34 and a received portion 36 of the body 24 of the workpiece 22 are receivable, so that a preselected portion 38 extends from the die 32 (FIGS. 6, 7). Preferably, the apparatus 20 also includes a first punch 40 adapted to cooperate with the die 32 to bend the preselected portion 38 of the workpiece 22 radially outwardly, i.e., in the direction indicated by arrow "A" in FIG. 7 to form a curled end 42. The apparatus also preferably includes a press means 46 for exerting a first force F1 on the first punch 40 to form the preselected portion 38 into the curled end 42 on the workpiece 22. In one embodiment, the apparatus 20 also includes a second punch 48 adapted to cooperate with the die 32 to press at least a preselected part 50 of the curled end 42 radially inwardly toward an inner part 90 of the curled end 42, to form a round reinforced end 44 (FIGS. 9, 9A, 10). Preferably, the press means 46 is further adapted to exert a second force F2 on the second punch 48 to form the curled end 42 into the round reinforced end 44 on the workpiece 22. In one embodiment, the apparatus 20 additionally includes a die subassembly 52 adapted for forming the received portion 36 of the body 24 of the workpiece 22 into the main portion 28 of the tube 26 having the substantially tetragonal cross-section (FIGS. 11A-13B), and also for forming the round reinforced end 44 into the reinforced end 30 of the tube 26. In addition, a third force F3 and a fourth force F4 are exerted on the die subassembly 52, to form the received portion 36 into the main portion 28 of the tube 26, and to form the round reinforced end 44 into the reinforced end 30 of the tube 26.

It will be understood that the forces referred to are schematically represented in the drawings by arrows respectively, which each indicate the direction in which the force is applied respectively. For example, force F1 is schematically represented by arrow F1 in FIGS. 7, 8, which indicates the direction in which the force is applied.

As can be seen in FIG. 6, the die 32 preferably has an internal cavity 54 with substantially the same shape and diameter as an exterior surface 56 of the body 24 of the workpiece 22. Those skilled in the art would be aware of the fit of the body 24 in the internal cavity 54 (i.e., the tolerance) which is suitable.

Preferably, the first punch 40 includes an interior portion 58 extending from an exterior portion 60. The interior portion 58 preferably has a substantially circular cross-section (not shown), with a diameter 62 which is substantially the same as an inside diameter 64 of the body 24 of the workpiece 22 (FIG. 6). Those skilled in the art would be aware of the fit of the first portion 58 in the body 24 (i.e., the tolerance) which is suitable. When the workpiece 22 is positioned in the die 32, the preselected portion 38 of the workpiece 22 extends above the die 32, and is not supported by the die 32 (FIG. 7).

Preferably, the interior portion 58 includes a contact surface 66 which is curved in a predetermined pattern. As schematically illustrated in FIGS. 7 and 8, the force F1 is applied to the exterior portion 60 by engagement of the press means 46 therewith, causing the first punch 40 to move downwardly, i.e., in the direction of F1. The contact surface 66 engages the preselected portion 38 when the first punch 40 is pressed downwardly by force F1 (FIGS. 7, 8), bending the preselected portion 38 radially outwardly (i.e., in the direction of arrow "A" in FIG. 7) until the preselected portion 38 has substantially the same shape (i.e., curvature) as the contact surface 66, at which point the curled end 42 is formed.

Press means are well known in the art, and therefore it is not necessary to provide further details regarding press means.

After the preselected portion 38 has been formed into the curled end 42, the first punch 40 is removed. The second punch 48 is then positioned on the curled end 42 (FIG. 9).

Figure 10A:
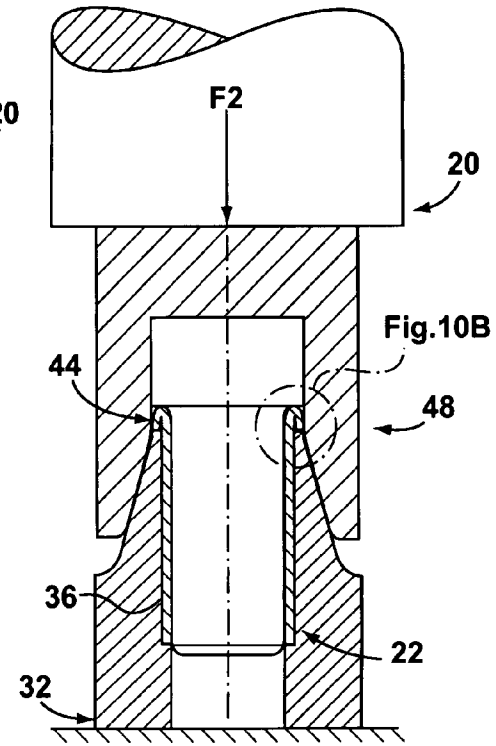
FIG. 10A is a cross-section of the workpiece, the die, and the second punch of FIGS. 9 and 9A in which the second punch forms a round reinforced end on the workpiece.

As can be seen in FIGS. 9, 9A, and 10A, the second punch 48 includes an inner portion 70 and an outer portion 72. The inner portion 70 has a first part 74 which is substantially circular in cross-section (not shown), with a diameter 76 approximately the same as the inside diameter 64 of the body 24. Those skilled in the art would be aware of the fit of the inner portion 70 in the body 24 (i.e., the tolerance) which is suitable.

The outer portion 72 preferably includes a first tapered surface 78 (FIGS. 9, 9A). As shown in FIGS. 9, 9A and 10A, the first tapered surface 78 preferably is formed to mate with a second tapered surface 80 on the die 32. When the second punch 48 is pressed downwardly by force F2 due to engagement of the outer portion 72 by the press means 46, the first tapered surface 78 engages a preselected part 50 of the curled end 42 (FIG. 9A). As the second punch 48 moves downwardly, the first tapered surface 78 presses the preselected part 50 substantially radially inwardly (i.e., in the direction shown by arrow "B" in FIG. 9A) toward an inner part 90 of the curled end 42 (FIGS. 9, 9A).

It is preferred that the inner portion 70 and the outer portion 72 include surfaces which are configured to form the curled end 42 into the round reinforced end 44, i.e., a lip on the workpiece, which is substantially round in cross-section. The inner portion 70 includes a main surface 84 which is substantially parallel to an outer surface 86, which surfaces 84, 86 preferably are spaced apart by a first predetermined distance (FIG. 9). The outer portion 72 also preferably includes a top surface 87 positioned substantially orthogonal to the outer surface 86 and the main surface 84. Preferably, the inner portion 70 also includes a curved portion 88 extending between the main surface 84 and the top surface 87. In addition, the die 32 preferably includes a bottom surface 89 which is substantially parallel to the top surface 87 and spaced apart from the top surface 87 by a second predetermined distance (FIG. 9).

As the second punch 48 is moved downwardly (i.e., in the direction in which force F2 is applied), after the preselected part 50 of the curled end 42 has been pressed inwardly by the first tapered surface 78, the preselected part 50 is engaged by the outer surface 86 and the top surface 87. Simultaneously, the balance of the curled end 42, being the inner part 90, is engaged by the main surface 84 and the curved surface 88 so that the inner part 90 is substantially conformed to such surfaces. The preselected part 50 is simultaneously pressed tightly against the inner part 90 by the top surface 87, the outer surface 86, and the bottom surface 89. The result is that, once the second punch 48 has moved as far as possible downwardly into the die 32 (FIG. 10A), the preselected part 50 is folded tightly against the inner part 90 to form the round reinforced end 44.

Figure 2B:
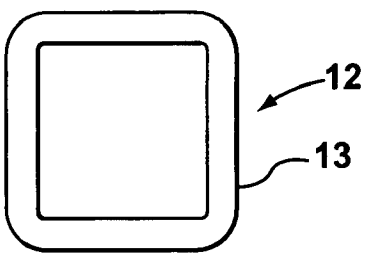
FIG. 2B (Prior Art)
FIG. 2B (also described previously) is an end view of the reinforced end of FIG. 2A.
Figure 2A:
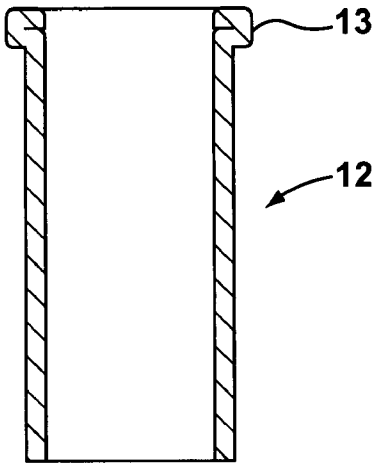
FIG. 2A (Prior Art)
FIG. 2A (also described previously) is a cross-section of a tube with a tetragonal cross-section in which a reinforced end of the prior art has been cold-formed due to the application of extreme pressure.
Figure 1B:
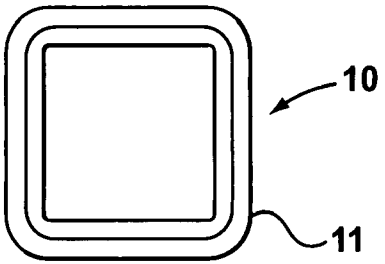
FIG. 1B (Prior Art)
FIG. 1B (also described previously) is an end view of the reinforced end of FIG. 1A.
Figure 1A:
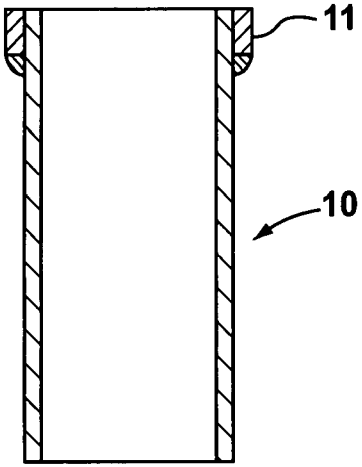
FIG. 1A (Prior Art)
FIG. 1A (also described previously) is a cross-section of a tube with a tetragonal cross-section in which a ring has been welded onto the tube to form a reinforced end of the prior art.

Because the round reinforced end 44 is formed while the body 24 of the workpiece 22 is substantially round in cross-section, the forces F1 and F2 which are exerted to form the curled end 42 are substantially less than the forces required to be exerted in order to form the reinforced end 13 on the tube 12 in the prior art (FIG. 2A). Due to less force being exerted in forming the round reinforced end 44, the method of the invention involves much lower costs, e.g., equipment, tooling and production costs, than the prior art method which results in the tube 12 shown in FIGS. 2A and 2B.

Figure 13A:
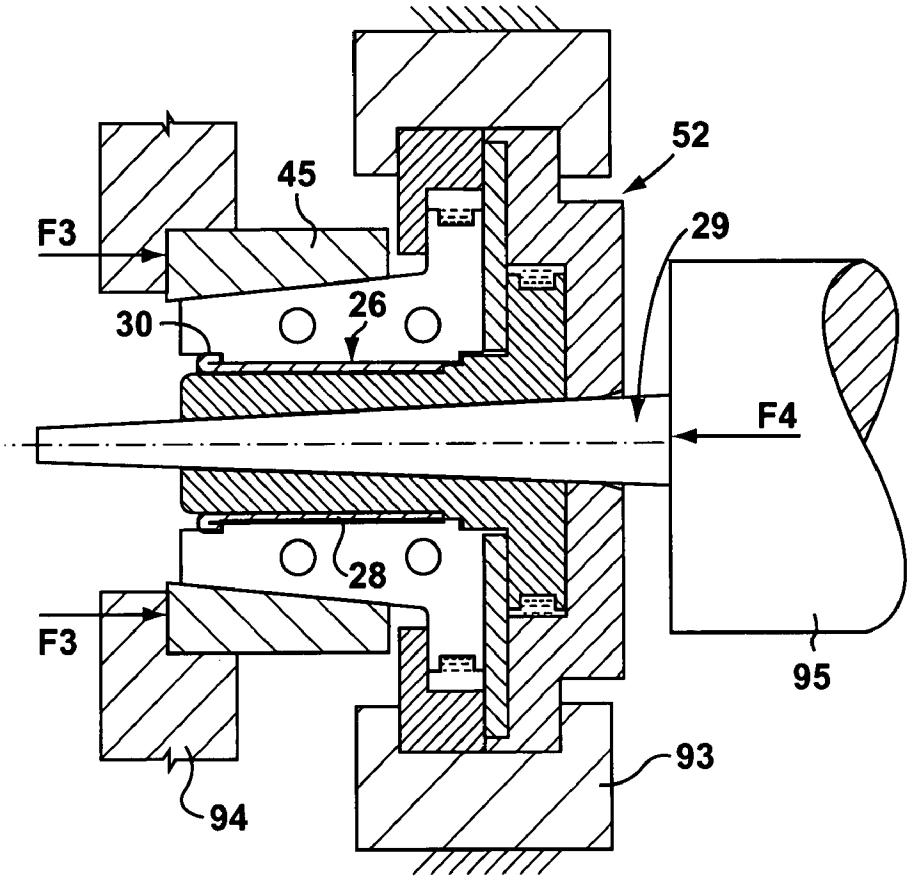
FIG. 13A is a cross-section of the die subassembly of FIG. 11A with the main portion of the tube formed in the die subassembly.
Figure 13B:
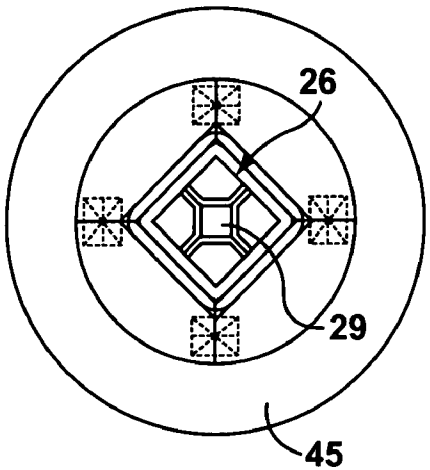
FIG. 13B is an end view of the die subassembly of FIG. 13A.

The die subassembly 52 preferably includes internal segments or fingers 21 having outer surfaces 23 which collectively define a substantially square shape (FIG. 11B), and inner tapered surfaces 25. Preferably, the internal segments 21 are held together by a first elastic member 27 (e.g., an elastic band). In one embodiment, the die subassembly 52 also includes a tapered mandrel 29 having a tapered surface 31 which is adapted to mate with the inner tapered surfaces 25. Preferably, the mandrel 29 is movable between a retracted position (FIG. 11A) and an extended position (FIG. 13A). In the retracted position (FIG. 11A), the mandrel 29 is positioned as far as possible to the right (as presented in FIG. 11A), so that the outer surfaces 23 are as close to each other as possible. In the extended position (FIG. 13A), the mandrel 29 is positioned as far as possible to the left (as presented in FIG. 13A), so that the outer surfaces 23 are as far apart from each other as possible. Accordingly, the internal segments 21 are substantially radially movable relative to each other with respect to an axis 57 of the mandrel 29 when the mandrel 29 moves relative to the internal segments 21. When the mandrel 29 is in the retracted position, the internal segments 21 are in a withdrawn condition (i.e., the outer surfaces 23 are as close to each other as possible) (FIG. 11A), and when the mandrel 29 is in the extended position, the internal segments 21 are in an expanded condition (i.e., the outer surfaces 23 are as far apart from each other as possible) (FIG. 13A).

It is also preferred that the die subassembly 52 includes external segments or jaws 33, with surfaces 35, 37 which collectively define two substantially square shapes respectively. The external segments 33 preferably includes outer tapered surfaces 39 and are biased to an open position by springs 41 and substantially held together by a second elastic member 43.

Figure 11A:
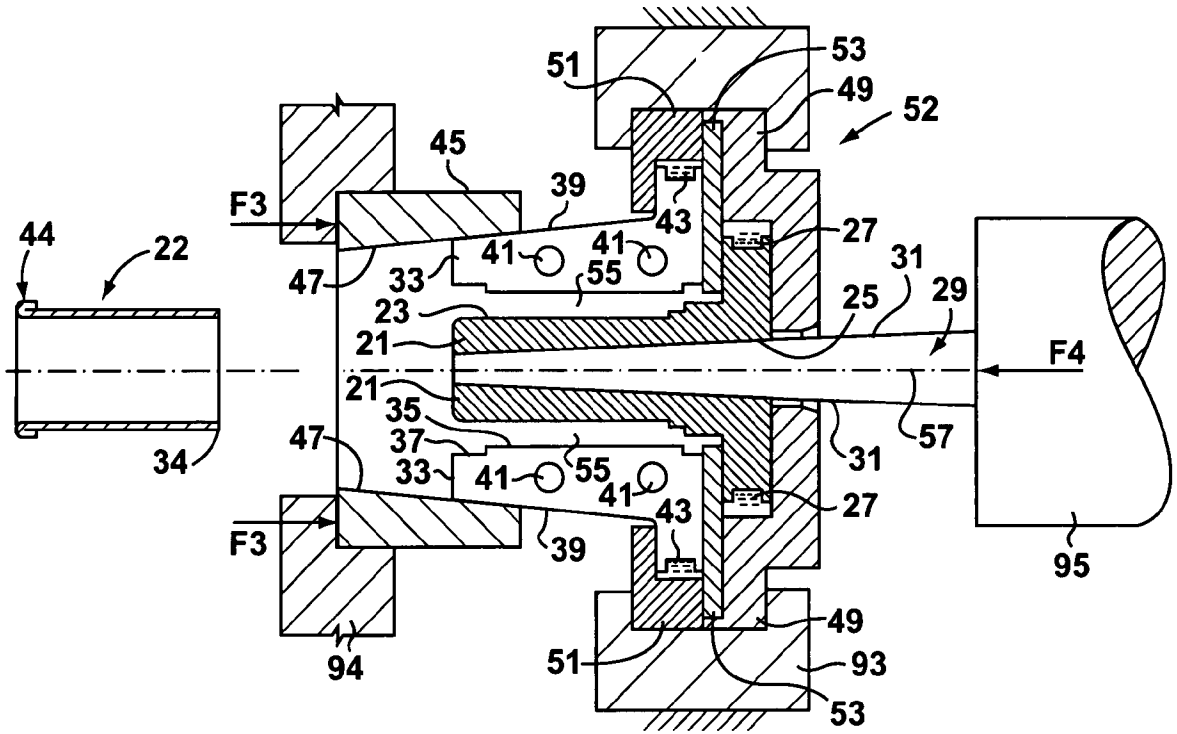
FIG. 11A is a cross-section of an embodiment of a die subassembly of the invention with the workpiece positioned to be inserted therein, drawn at a smaller scale.
Figure 11B:
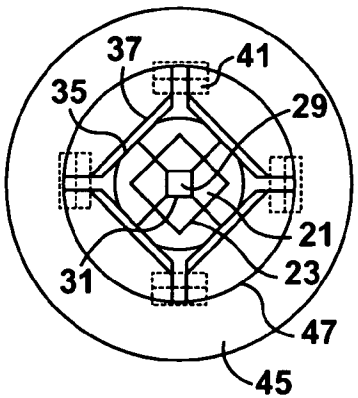
FIG. 11B is an end view of the die subassembly of FIG. 11A.

In one embodiment, the die subassembly 52 also includes a cone element 45 with a tapered surface 47 configured to mate with outer tapered surfaces 39 of the external segments 33. As can be seen in FIGS. 11A and 13A, the cone element 45 is movable between a retracted position (FIG. 11A), in which the cone element 45 is disengaged from the external segments 33, and an extended position (FIG. 13A), in which the tapered surface 47 mates with the outer surfaces 39 of the external segments 33. The cone element 45 is substantially coaxial with the mandrel 29. The external segments 33 are substantially radially movable relative to each other with respect to the axis 57 when the cone element 45 moves relative to the external segments 33, as will also be described. When the cone element 45 is in the retracted condition, the external segments 33 are in an expanded condition (FIG. 11A), and when the cone element 45 is in the extended position, the external segments 33 are in a contracted condition (FIG. 13A).

Figure 12A:
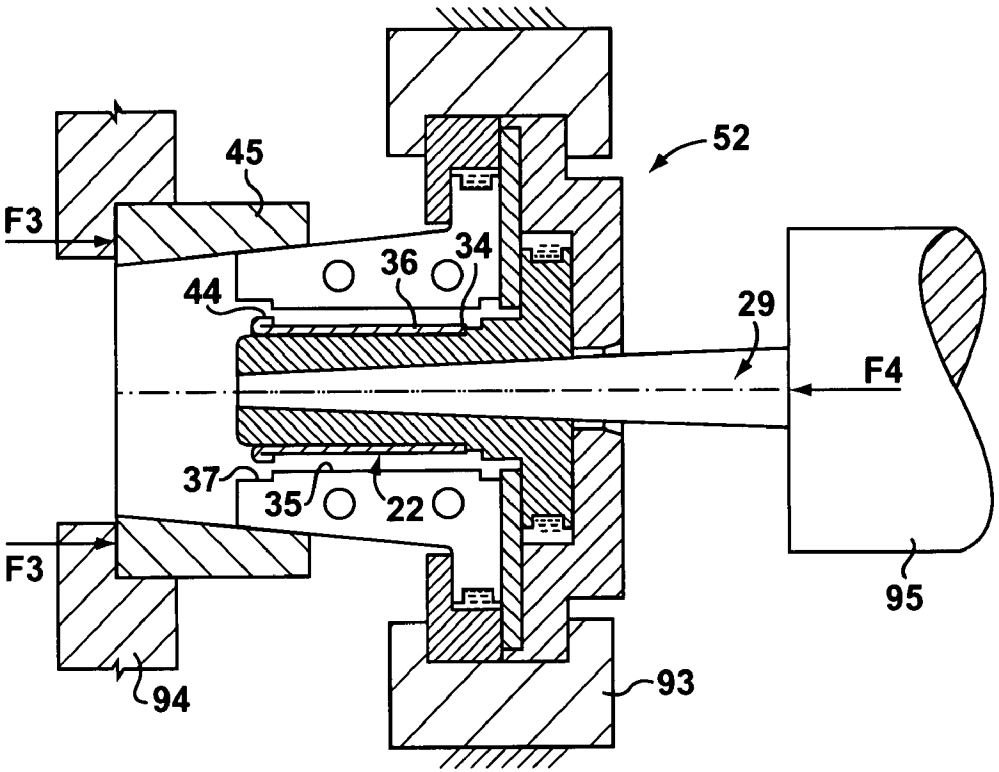
FIG. 12A is a cross-section of the die subassembly with the workpiece positioned therein.
Figure 12B:
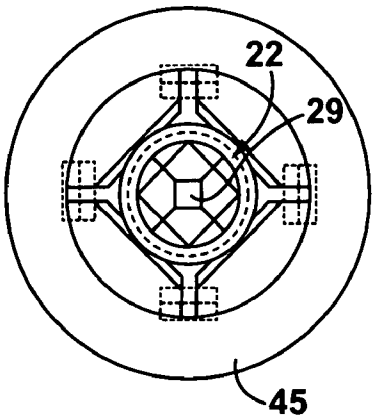
FIG. 12B is an end view of the die subassembly of FIG. 12A.

Preferably, the die subassembly 52 also includes retainers 49, 51 which are at least partially separated by a separator plate 53, and which are intended to at least partially retain the internal segments 21 and the external segments 31 in a range of positions relative to each other (FIG. 11A). As shown in FIGS. 11A, 12A, and 13A, the retainers 49, 51 preferably are mounted in mounting means 93 which hold the retainers 49, 51 substantially stationary relative to the mandrel 29 and the cone element 45.

As can be seen in FIGS. 11A and 12A, the workpiece 22, with the round reinforced end 44 thereon, is positioned in a gap 55 (FIG. 11A) with the first end 34 of the workpiece 22 leading, so that the surfaces 37 are positioned for engagement with the round reinforced end 44, and the surfaces 35 are positioned for engagement with the received portion 36 of the workpiece 22. As can be seen in FIG. 11A, the gap 55 is between the surfaces 35, 37 of the external segments 33 and the outer surfaces 23 of the internal segments 21. Accordingly, when the workpiece 22 is positioned in the gap 55, the workpiece 22 is positioned over (i.e., around) the internal segments 21 and inside the external segments 33.

As schematically illustrated in FIGS. 11A, 12A, and 13A, the cone element 45 is moved from its retracted position to its extended position by the third force F3 applied to the cone element 45 by a press means 94. Similarly, and at substantially the same time, the mandrel 29 is moved from its retracted position to its extended position by the fourth force F4 applied to the mandrel 29 by a press means 95 in a direction opposite to the direction of force F3.

The ultimate results of these two substantially simultaneous movements are, respectively, that the external segments 33 are in the contracted condition, and the internal segments 21 are in the expanded condition. As the external segments 33 move from the expanded condition to the contracted condition, they press substantially radially inwardly on the workpiece, i.e., they apply pressure to the workpiece from the outside in. Similarly, as the internal segments 21 move from the withdrawn condition to the expanded condition, they also press substantially radially on the workpiece, i.e., they apply pressure to the workpiece from the inside out. The simultaneous squeezing (from the outside in) and pushing (from the inside out) causes the received portion 36 to conform to the substantially square shapes defined by the surfaces 35 and the outer surfaces 23 (FIGS. 13A, 13B), to form the received portion 36 (with a round cross-section) into the main portion 28 (with a substantially square cross-section).

Similarly, the simultaneous squeezing and pushing on the workpiece 22 causes the round reinforced end 44 to conform to the substantially square shapes defined by the surfaces 37 and the outer surfaces 23.

Figure 3C:
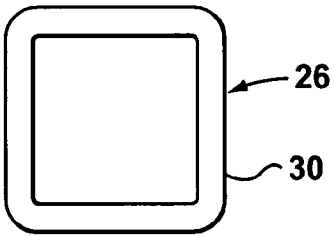
FIG. 3C is an end view of the reinforced end of the tube of FIG. 3A, drawn at a smaller scale.
Figure 3A:
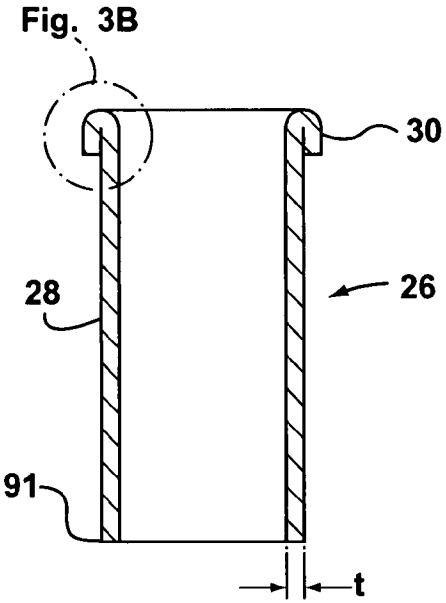
FIG. 3A is a cross-section of an embodiment of a tube of the invention including an embodiment of a reinforced end of the invention.

As shown in FIGS. 3A and 5C, the tube 26 includes an end 91 of the main portion 28 which is distal to the reinforced end 30.

It will be evident to those skilled in the art that the die subassembly 52, with appropriate adjustments thereto, is suitable for forming workpieces with substantially round cross-sections into tubes with other tetragonal cross-sections, e.g., substantially rectangular cross-sections. In addition, with suitable adjustments, tubes with cross-sections other than tetragonal cross-sections may be formed, if desired. In addition, those skilled in the art would be aware of various alternative arrangements for forming workpieces with round cross-sections into tubes with tetragonal or other cross-sections.

Figure 16:
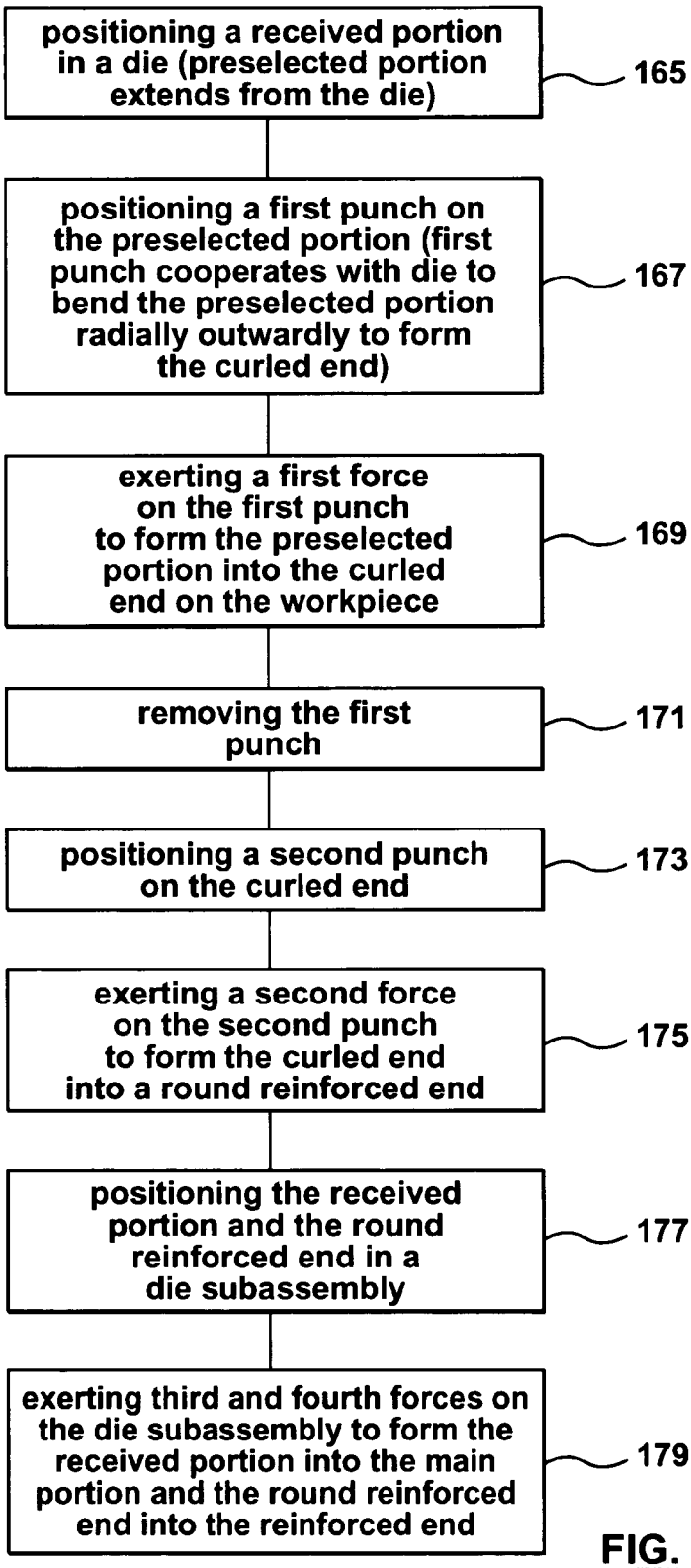
FIG. 16 is a schematic illustration of an embodiment of a method of the invention.

In use, the tube 26 preferably is formed, first, by positioning the received portion 36 of the workpiece 22 in the die 32, so that a preselected portion 38 of the workpiece 22 extends from the die (FIG. 16, step 165). Next, the first punch 40 is positioned on the preselected portion 38 (step 167). As described above, the first punch 40 is adapted to cooperate with the die 32 to bend the preselected portion 38 substantially radially outwardly to form the curled end 42 on the workpiece 22. In the next step, the press means 46 exerts the first force F1 on the first punch 40 to form the preselected portion 38 into the curled end 42 on the workpiece 22 (step 169). The first punch 40 is then removed (step 171).

Next, the second punch 48 is positioned on the curled end 42 of the workpiece (step 173). The press means 46 then exerts the second force F2 on the second punch 48 to press the preselected part 50 of the curled end 42 substantially radially inwardly toward the inner part 90 of the curled end 42 to form the round reinforced end 44 (step 175).

Next, the received portion 36 and the round reinforced end 44 are positioned in the die subassembly 52 (step 177). Finally, third and fourth forces F3, F4 are exerted on the die subassembly 52 (i.e., the forces F3, F4 being applied in directions opposite to each other) to form the received portion 36 into the main portion 28 of the tube 26 and to form the round reinforced end 44 into the reinforced end of the tube 26 (step 179).

Additional embodiments of the invention are disclosed in FIGS. 14A, 14B, 15A, 15B, and 17. In FIGS. 14A, 14B, 15A, 15B, and 17, elements are numbered so as to correspond to like elements shown in FIGS. 3A-13B and 16.

Figure 3B:
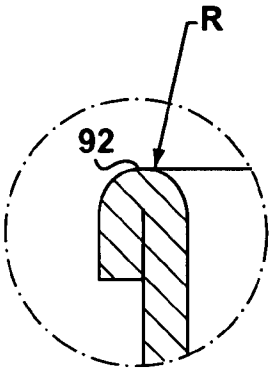
FIG. 3B is a portion of FIG. 3A, drawn at a larger scale.

As shown in FIGS. 3A and 3B, the reinforced end 30 has a curved part 92 curved with a radius "R" which is substantially equal to the wall thickness ("t") of the tube 26. The tube 26 is ready for use in certain applications.

Figure 4C:
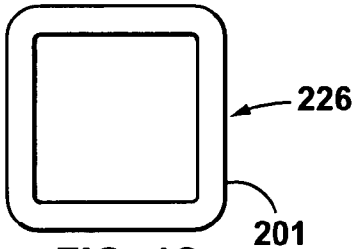
FIG. 4C is an end view of the modified tube of FIG. 4A, drawn at a smaller scale.
Figure 4A:
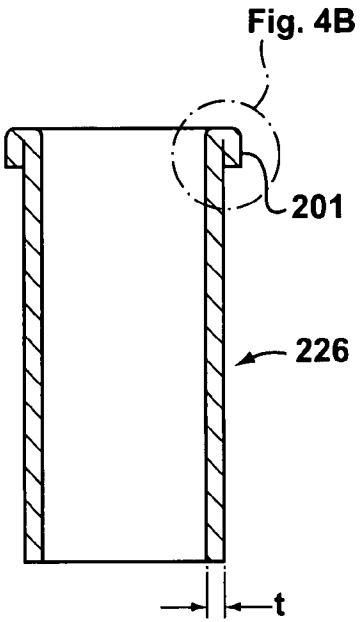
FIG. 4A is a cross-section of an embodiment of a modified tube of the invention.
Figure 4B:
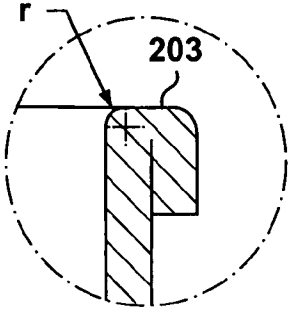
FIG. 4B is a portion of FIG. 4A, drawn at a larger scale.

However, in certain other applications, another embodiment of a modified tube 226 of the invention (FIGS. 4A, 4B, 15A, 15B) is preferred. In the modified tube 226, instead of the curved part 92 curved with the radius "R", the modified tube 226 has a modified reinforced end 201 with a flattened part 203, which is formed in a manner to be described. Due to the flattened part 203, a rounded inside corner surface 205 has a somewhat reduced radius "r" (FIGS. 4B, 15A, 15B) which is less than the wall thickness "t" (FIG. 4A).

Figures 14A, 14B, 15A, 15B:
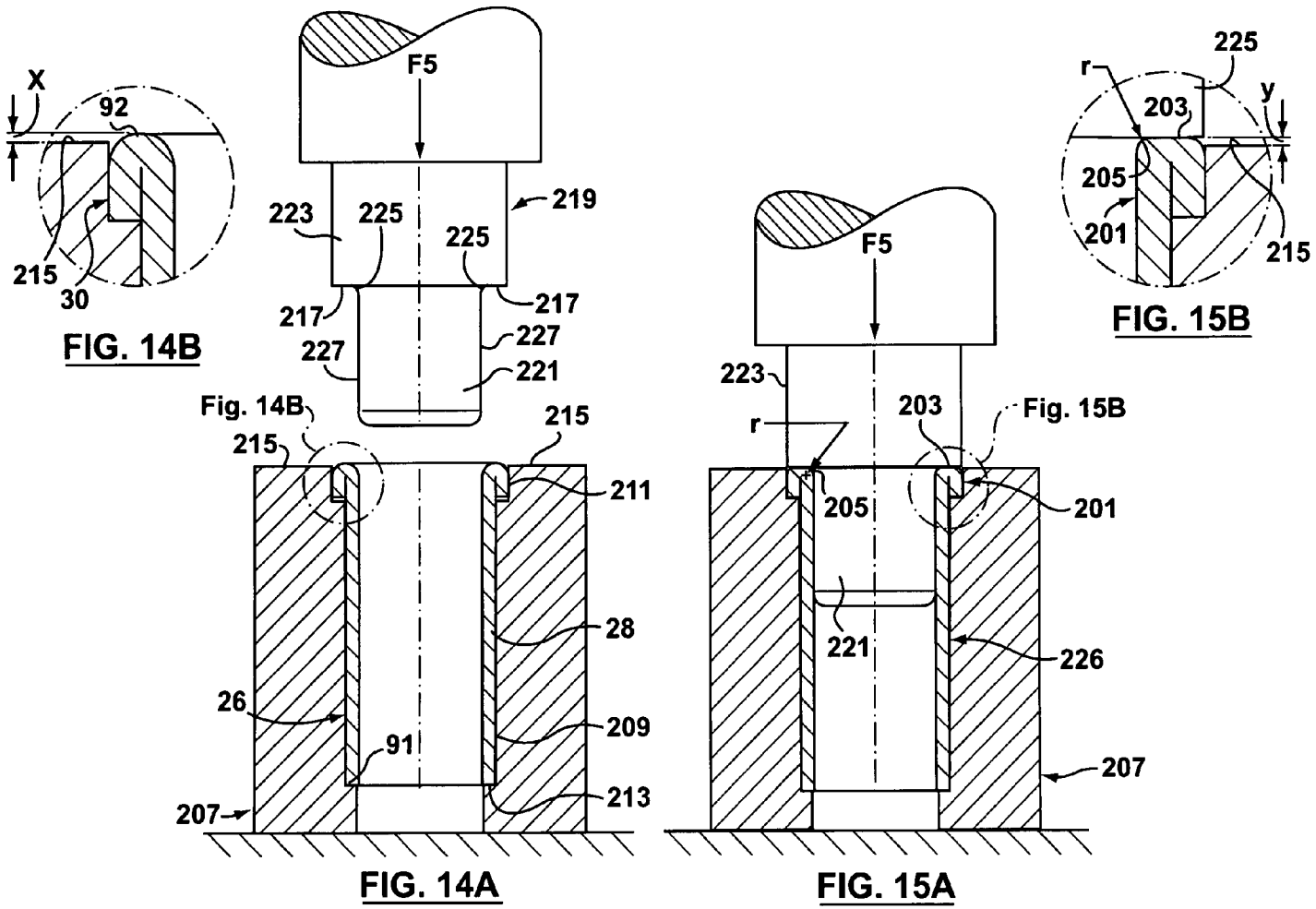
FIG. 14A is a cross-section of another embodiment of a die of the invention with the tube having a reinforced end partially positioned therein, drawn at a larger scale.
FIG. 14B is a portion of FIG. 14A, drawn at a larger scale.
FIG. 15A is a cross-section of the die of FIG. 14A with a modified tube of the invention partially positioned therein, drawn at a smaller scale.
FIG. 15B is a portion of FIG. 15A, drawn at a larger scale.

To form the modified reinforced end 201, first, the tube 26 is positioned in a die 207 (FIG. 14A). As can be seen in FIG. 14A, the die 207 includes an inner cavity 209 in which the main portion 28 of the tube 26 is receivable, and an outer cavity 211 in which the reinforced end 30 is receivable. Those skilled in the art would be aware of the fit of the main portion 28 in the inner cavity 209, and the fit of the reinforced end 30 in the outer cavity 211 respectively (i.e., the tolerance), which is suitable.

The end 91 of the tube 26 is supported by an inside corner 213 in the inner cavity 209 (FIG. 14A). The die 207 also includes a top surface 215. A third punch 219 includes an engagement surface 217. As can be seen in FIG. 14B, when the tube 26 is positioned in the die 207, the curved part 92 of the reinforced end 30 preferably extends a predetermined distance "X" above the top surface 215 of the die 207.

In one embodiment, the third punch 219 includes an inner portion 221 receivable in the main portion 28 of the tube 26, and an outer portion 223 with a shoulder 225 between the inner and outer portions 221, 223. The engagement surface 217 is disposed on the outer portion 223. The shoulder 225 joins an exterior surface 227 of the inner portion 221 with the engagement surface 217, and as shown in FIGS. 14A and 15A, the shoulder 225 preferably is curved and has a radius 229 which is approximately "r".

It is preferred that the third punch 219 is pressed onto the reinforced end 30 by a force F5 (FIG. 15A). The engagement surface 217 engages the curved part 92 and presses the curved part 92 downwardly (i.e., in the direction indicated by arrow F5 in FIG. 15A) until the curved part 92 is substantially flattened, to form the flatted part 203, and also thereby forming the modified reinforced end 201. After the flattened part 203 has been formed, the inside corner surface 205 has a radius which is approximately "r", i.e., the inside corner surface 205 conforms to the shoulder 225 on the third punch 219. As shown in FIG. 15B, after the flattened part 203 has been formed, the flattened part 203 is preferably disposed a predetermined distance "Y" above the top surface 215.

Figure 17:
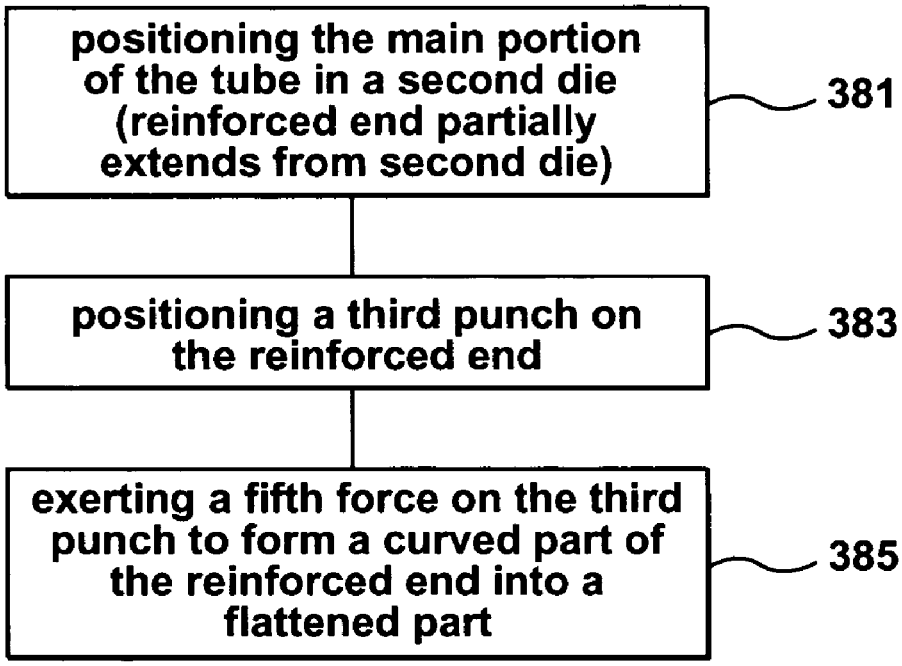
FIG. 17 is a schematic illustration of another embodiment of a method of the invention.

As shown in FIG. 17, the modified tube 226 preferably is formed, first, by positioning the main portion 28 of the tube 26 in the second die 207, so that the reinforced end 30 extends from the second die 207 by the predetermined distance X (step 381). Next, the third punch 219 is positioned on the reinforced end 30, and in particular, on the curved part 92 of the reinforced end 30 (step 383). Next, the fifth force F5 is exerted on the third punch 219 to form the curved part 92 of the reinforced end 30 into the flattened part 203, thereby forming the reinforced end 30 into the modified reinforced end 201 (step 385).

Figures 18A, 18B, 19A, 19B:
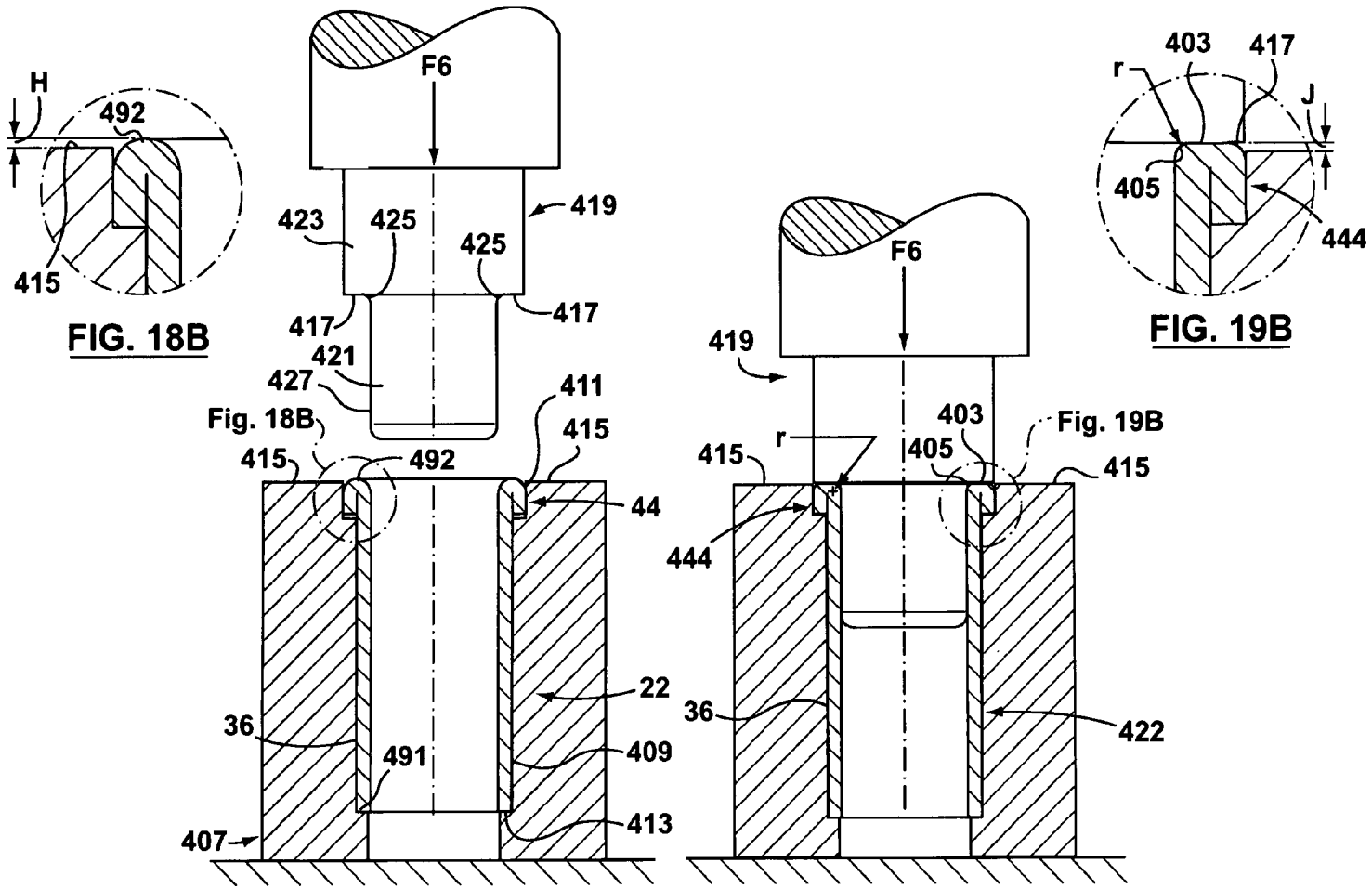
FIG. 18A is a cross-section of another embodiment of a die of the invention with the workpiece having the round reinforced end partially positioned therein, drawn at a smaller scale.
FIG. 18B is a portion of FIG. 18A, drawn at a larger scale.
FIG. 19A is a cross-section of the die of FIG. 18A with a modified workpiece of the invention partially positioned therein, drawn at a smaller scale.
FIG. 19B is a portion of FIG. 19A, drawn at a larger scale.
Figure 20A:
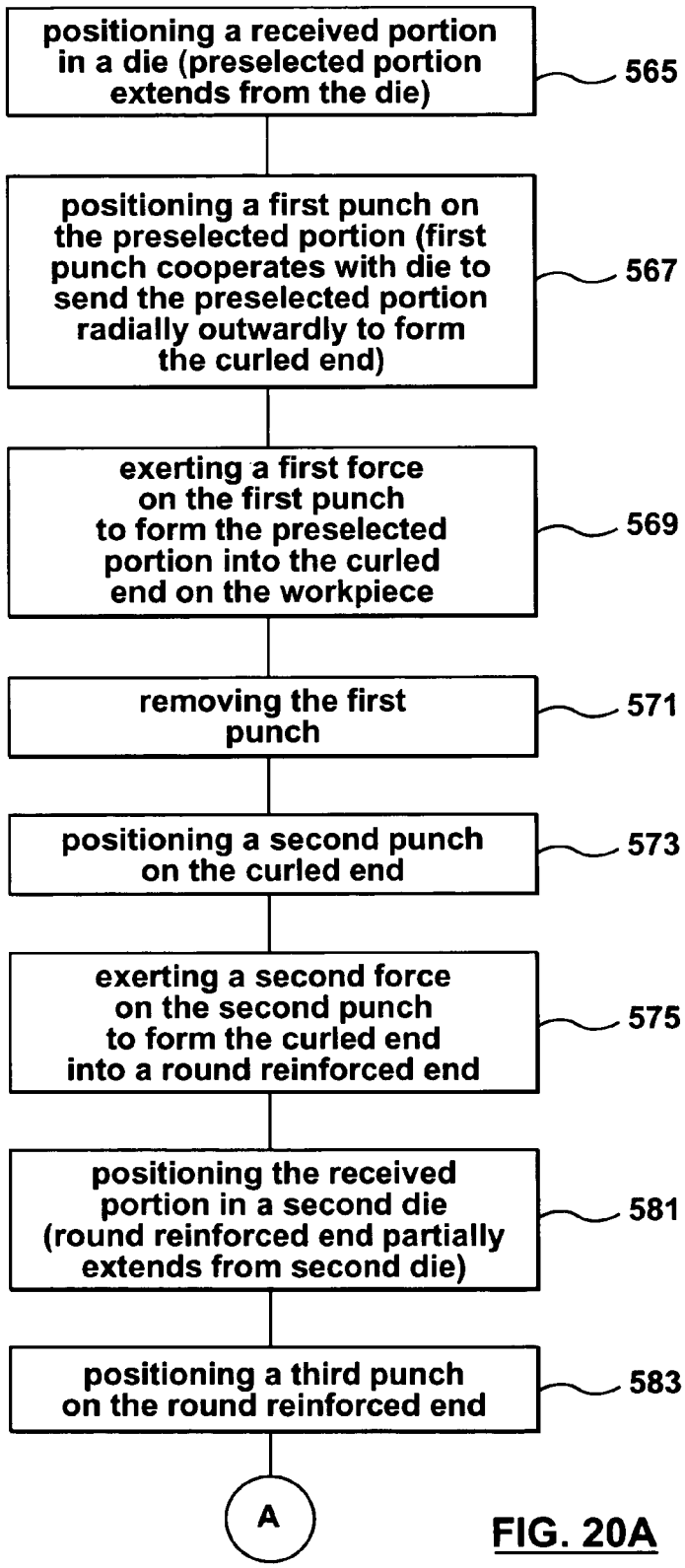
FIG. 20A is a schematic illustration of a portion of another method of the invention.

In another embodiment, the workpiece 22 is formed into a modified workpiece 422 when the round reinforced end 44 is formed into a modified round reinforced end 444, as shown in FIGS. 18A-19B. In order to form the modified workpiece 422, first, the received portion 36 of the workpiece is positioned in the die 32 (FIGS. 6-8), with the preselected portion 50 extending from the die (FIG. 20A, step 565). Next, the first punch 40 is positioned on the preselected portion 50, as shown in FIG. 7 (step 567). In the next step, the first force is exerted on the first punch 40 to form preselected portion 50 into the curled end 42 on the workpiece 22, as shown in FIG. 8 (step 569). Next, the first punch 40 is removed (step 571). In the next step, the second punch 48 is positioned on the curled end 42, as shown in FIG. 9 (step 573). The second force is exerted on the second punch to form the curled end into the round reinforced end 44, as shown in FIGS. 9A and 10A (step 575). Next, the received portion 36 is positioned in a second die 407 (as shown in FIG. 18A), so that at least a portion of the round reinforced end 44 extends from the second die, as shown in FIGS. 18A and 18B (step 581). In the next step, a third punch 419 is positioned on the round reinforced end 44, as shown in FIG. 19A (step 583). Next, the sixth force is exerted on the third punch 419 to form a curved end part 492 of the round reinforced end 44 into a flattened end part 403, as shown in FIGS. 19A and 19B (FIG. 20B, step 585), thereby forming the round reinforced end 44 into the modified round reinforced end 444.

The apparatus required for steps 581, 583, and 585 is shown in FIGS. 18A-19B. As can be seen in FIGS. 18A and 19A, the die 407 includes an inner cavity 409 in which the received portion 36 of the workpiece 22 is receivable. The die 407 also includes an outer cavity 411 in which the round reinforced end 44 of the workpiece 22 is partially receivable. Those skilled in the art would be aware of the fit of the received portion 36 in the inner cavity 409 and the fit of the round reinforced end 44 in the outer cavity 411 respectively (i.e., the tolerance) which is suitable. Preferably, an end 491 of the workpiece 22 is supported by an inside corner 413 in the inner cavity 409 (FIG. 18A). As can be seen in FIG. 18B, when the workpiece 22 is positioned in the die 407, the curved end part 492 projects above a top surface 415 of the die 407 by a predetermined distance "H".

The punch 419 includes an inner portion 421 receivable in the received portion 36 (FIG. 19A) and an outer portion 423. The inner portion includes a shoulder 425 between the inner and outer portions 421, 423 which joins an exterior surface 427 of the inner portion 421 and an engagement surface 417 of the outer portion 423 (FIG. 18A).

As can be seen in FIGS. 18A-19B, when the punch 419 is pressed downwardly with force F6, the curved end part 492 is engaged by the engagement surface 417 and the shoulder 425. Because of this, the curved end part 492 is pressed downwardly (i.e., in the direction indicated by arrow F6 in FIG. 19A) until the curved end part 492 is substantially flattened, to form the flattened end part 403, and also thereby forming the modified round reinforced end 444. After the flattened end part 403 has been formed, an inside corner surface 405 of the modified round reinforced end 444 has a radius "r", being substantially the same as the radius of the shoulder 425, i.e., the inside corner surface 405 conforms to the shoulder 425 on the punch 419. The radius "r" is less than the wall thickness "t". As shown in FIG. 19B, after the flattened end part 403 has been formed, the flattened end part 403 preferably is disposed a predetermined distance "J" above the top surface 415. The net result is that, when the curved end part 492 is at least partially formed into the flattened end part 403, the round reinforced end 44 is formed into the modified round reinforced end 444, and the workpiece 22 is formed into the modified workpiece 422.

Figure 21:
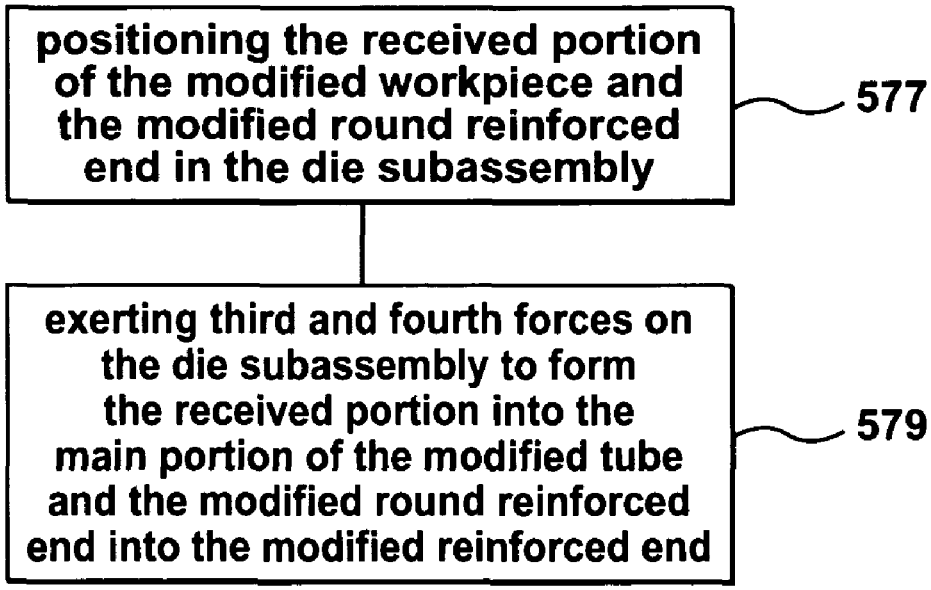
FIG. 21 is a schematic illustration of another embodiment of the method of the invention.

As schematically illustrated in FIG. 21, the modified workpiece 422 preferably is formed into the modified tube 226. In the first step, the received portion 36 of the modified workpiece 422 and the modified round reinforced end 444 are positioned in the die subassembly 52 (FIG. 21, step 577). Next, third and fourth forces are exerted on the die subassembly 52, to form the received portion 36 into the main portion 28 of the modified tube 226, and also to form the modified round reinforced end 444 into the modified reinforced end 201 (step 579), to provide the modified tube 226.

Figure 20B:
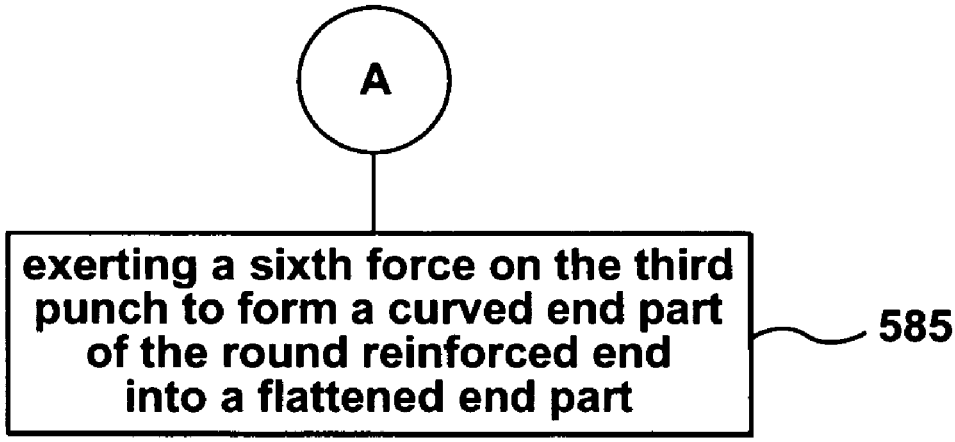
FIG. 20B is a schematic illustration of another portion of the method of the invention partially disclosed in FIG. 20A.

From the foregoing, it can be seen that the embodiment of the method of the invention schematically illustrated in FIGS. 20A, 20B, and 21 is an alternative to the embodiment of the method schematically illustrated in FIGS. 16 and 17.

Any element in a claim that does not explicitly state "means for" performing a specific function, or "step for" performing a specific function, is not to be interpreted as a "means" or "step" clause as specified in 35 U.S.C. § 112, para. 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

I claim:

1. An apparatus for cold-forming a workpiece having a substantially round cross-section and an elongate body into a tube having a main portion with a substantially tetragonal cross-section and a reinforced end, the apparatus comprising:

a die in which a received portion of the body of the workpiece is receivable, and from which a preselected portion of the body extends;

a first punch adapted to cooperate with the die to bend the preselected portion radially outwardly to form a curled end on the workpiece;

press means for exerting a first force on the first punch to form the preselected portion into the curled end on the workpiece;

a second punch adapted to cooperate with the die to press a preselected part of the curled end radially inwardly toward an inner part of the curled end, to form a round reinforced end;

press means for exerting a second force on the second punch to form the curled end into the round reinforced end on the workpiece;

a die subassembly adapted for forming the received portion of the body of the workpiece into the main portion of the tube having the substantially tetragonal cross-section and for forming the round reinforced end into the reinforced end of the tube; and additional press means adapted to exert third and fourth forces on the die subassembly respectively for forming the received portion into the main portion of the tube and for forming the round reinforced end into the reinforced end of the tube.

2. An apparatus according to claim 1 additionally comprising means for forming the tube into a modified tube by forming the reinforced end into a modified reinforced end, said means comprising:

a second die in which the main portion of the tube is receivable;

a third punch for forming a curved part of the reinforced end into a flattened part of the modified reinforced end; and press means adapted to exert a fifth force on the curved part to form the flattened part.

3. A method for cold-forming a workpiece having a substantially round cross-section and an elongate body into a tube having a main portion with a substantially tetragonal cross-section and a reinforced end, the method comprising the steps of:

(a) positioning a received portion of the body of the workpiece in a die, such that a preselected portion of the body extends from the die;

(b) positioning a first punch on the preselected portion, the first punch being adapted to cooperate with the die to bend the preselected portion radially outwardly to form a curled end on the workpiece;

(c) exerting a first force on the first punch to form the preselected portion into the curled end on the workpiece;

(d) removing the first punch;

(e) positioning a second punch on the curled end of the workpiece;

(f) exerting a second force on the second punch to press a preselected part of the curled end radially inwardly toward an inner part of the curled end to form a round reinforced end;

(g) positioning the received portion and the round reinforced end in a die subassembly adapted for forming the received portion into the main portion of the tube having the substantially tetragonal cross-section and for forming the round reinforced end into the reinforced end of the tube; and (h) exerting third and fourth forces on the die subassembly to form the received portion into the main portion of the tube and to form the round reinforced end into the reinforced end of the tube.

4. A method according to claim 3 additionally comprising:

(i) positioning the main portion of the tube in a second die;

(j) positioning a third punch on the reinforced end, the third punch being adapted to form a curved part of the reinforced end into a flattened part of a modified reinforced end; and (k) exerting a fifth force on the third punch to form the curved part into the flattened part.

5. An apparatus for cold-forming a workpiece having a substantially round cross-section and an elongate body into a modified tube having a main portion with a substantially tetragonal cross-section and a modified reinforced end, the apparatus comprising:

a die in which a received portion of the body of the workpiece is receivable, and from which a preselected portion of the body extends;

a first punch adapted to cooperate with the die to bend the preselected portion radially outwardly to form a curled end on the workpiece;

press means for exerting a first force on the first punch to form the preselected portion into the curled end on the workpiece;

a second punch adapted to cooperate with the die to press a preselected part of the curled end radially inwardly toward an inner part of the curled end, to form a round reinforced end;

press means for exerting a second force on the second punch to form the curled end into the round reinforced end on the workpiece;

a second die in which the received portion of the workpiece is receivable and at least a curved end part of the round reinforced end extends beyond the second die;

a third punch for forming the curved end part of the round reinforced end into a flattened end part of a modified round reinforced end of a modified workpiece; and press means adapted to exert a sixth force on the curved end part to form the flattened end part.

6. An apparatus according to claim 5 additionally comprising:

a die subassembly adapted for forming the received portion of the body of the modified workpiece into the main portion of the modified tube having the substantially tetragonal cross-section and for forming the modified round reinforced end into the modified reinforced end of the modified tube; and additional press means adapted to exert third and fourth forces on the die subassembly respectively for forming the received portion into the main portion of the modified tube and for forming the modified round reinforced end into the modified reinforced end of the modified tube.

7. A method for cold-forming a workpiece having a substantially round cross-section and an elongate body into a modified tube having a main portion with a substantially tetragonal cross-section and a modified reinforced end, the method comprising the steps of:

(a) positioning a received portion of the body of the workpiece in a die, such that a preselected portion of the body extends from the die;

(b) positioning a first punch on the preselected portion, the first punch being adapted to cooperate with the die to bend the preselected portion radially outwardly to form a curled end on the workpiece;

(c) exerting a first force on the first punch to form the preselected portion into the curled end on the workpiece;

(d) removing the first punch;

(e) positioning a second punch on the curled end of the workpiece;

(f) exerting a second force on the second punch to press a preselected part of the curled end radially inwardly toward an inner part of the curled end to form a round reinforced end;

(g) positioning the received portion of the workpiece in a second die in which the received portion of the workpiece is receivable, such that at least a curved end part of the round reinforced end extends beyond the second die when the received portion is received therein;

(h) positioning a third punch on the round reinforced end, the third punch being adapted to form a curved end part of the round reinforced end into a flattened end part of the modified round reinforced end, to provide a modified workpiece; and (i) exerting a fifth force on the third punch to form the curved end part into the flattened end part.

8. A method according to claim 7 additionally comprising:

(j) positioning the received portion and the modified round reinforced end of the modified workpiece in a die subassembly adapted for forming the received portion into the main portion of the modified tube having the substantially tetragonal cross-section and for forming the modified round reinforced end into the modified reinforced end of the modified tube; and (k) exerting third and fourth forces on the die subassembly to form the received portion into the main portion of the modified tube and to form the modified round reinforced end into the modified reinforced end of the modified tube.

* * * * *